US010352114B2

(12) United States Patent
Newman et al.

(10) Patent No.: US 10,352,114 B2
(45) Date of Patent: Jul. 16, 2019

(54) GUIDE APPARATUS FOR TUBULAR MEMBERS IN A SNUBBING UNIT

(71) Applicant: Oceaneering International, Inc., Houston, TX (US)

(72) Inventors: Kenneth R. Newman, New Waverly, TX (US); Travis Lee Bolt, Conroe, TX (US); Brandon Harman, Spring, TX (US)

(73) Assignee: Oceaneering International, Inc., Houston, TX (US)

( * ) Notice: Subject to any disclaimer, the term of this patent is extended or adjusted under 35 U.S.C. 154(b) by 44 days.

(21) Appl. No.: 15/049,880

(22) Filed: Feb. 22, 2016

(65) Prior Publication Data

US 2016/0245026 A1 Aug. 25, 2016

Related U.S. Application Data

(60) Provisional application No. 62/119,661, filed on Feb. 23, 2015.

(51) Int. Cl.
*E21B 19/24* (2006.01)
*E21B 19/086* (2006.01)

(52) U.S. Cl.
CPC ..... *E21B 19/24* (2013.01); *E21B 19/086* (2013.01)

(58) Field of Classification Search
CPC ..... E21B 19/24; E21B 19/086
USPC ..... 166/77.4
See application file for complete search history.

(56) References Cited

U.S. PATENT DOCUMENTS

| | | | | |
|---|---|---|---|---|
| 5,094,340 | A | 3/1992 | Avakov | |
| 5,988,274 | A | 11/1999 | Funk | |
| 5,992,516 | A * | 11/1999 | Palynchuk | E21B 19/22 166/77.2 |
| 6,116,345 | A | 9/2000 | Fontana et al. | |
| 6,158,516 | A | 12/2000 | Smith et al. | |
| 6,854,520 | B1 | 2/2005 | Robicheaux | |
| 2003/0178200 | A1 | 9/2003 | Fox et al. | |
| 2006/0078390 | A1 | 4/2006 | Olsen et al. | |
| 2007/0084606 | A1 | 4/2007 | Ponville | |
| 2011/0284234 | A1 | 11/2011 | Portman | |
| 2012/0006565 | A1 | 1/2012 | McKinnon et al. | |
| 2014/0326454 | A1 * | 11/2014 | Giroux | E21B 4/02 166/285 |

* cited by examiner

*Primary Examiner* — Taras P Bemko
(74) *Attorney, Agent, or Firm* — Maze IP Law, P.C.

(57) ABSTRACT

The guide apparatus for tubular members prevents buckling, when a snubbing unit inserts the tubular member into a well. The guide apparatus includes a lower slotted cylinder having a plurality of rib extensions projecting upward so as to form lower slots, and an upper slotted cylinder a plurality of complementary rib extensions projecting downward so as to form upper slots. The lower slotted cylinder engages the upper slotted cylinder by sliding the rib extensions into the upper slots and the complementary rib extensions into the lower slots. The guide apparatus coordinates the slotted cylinders with traveling slip bowls and stationary slip bowls of a snubbing unit so that relative movement of the slotted cylinders corresponds to movement of the slip bowls. The rib extensions, the complementary rib extensions, or both support the entire length of tubular member between the slip bowls, when being snubbed.

20 Claims, 3 Drawing Sheets

GUIDE APPARATUS FOR TUBULAR MEMBERS IN A SNUBBING UNIT

CROSS-REFERENCE TO RELATED APPLICATIONS

The present application claims priority under 35 U.S.C. Section 119(e) from U.S. Provisional Patent Application Ser. No. 62/119,661, filed on 23 Feb. 2015, entitled "PIPE GUIDE APPARATUS FOR A SNUBBING UNIT".

See also Application Data Sheet

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a guide apparatus for tubular members being inserted into a well under pressure by a snubbing unit. More particularly, the present invention relates to a guide apparatus to prevent buckling of a tubular member in the snubbing unit. Even more particularly, the present invention relates to a guide for unsupported length of a tubular member between the traveling slip bowls and the stationary slip bowls of a snubbing unit.

2. Description of Related Art Including Information Disclosed Under 37 CFR 1.97 and 37 CFR 1.98.

Oil and gas fields on the ocean floor require subsea production systems for exploring, drilling, and producing under extreme environmental conditions. Subsea production systems are specialized equipment to develop these remote oil and gas fields, while being economically cost-effective and safe guarding the environment. Subsea wells present difficult problems because the wellbore is located thousands of feet from the ocean surface. The ability to erect a rig and overhead support is severely limited and expensive. The locations are remote; the equipment itself is difficult to transport and to deploy; the delivery of building and maintenance resources spans large underwater distances; and the expense of intervention can risk economic failure of an entire subsea production system.

A snubbing unit is a type of specialized equipment for oil production and well intervention. The snubbing unit or "hydraulic workover unit" or "snubbing jack" pushes tubular members, such as pipe, coiled tubing and wireline, into a well against pressure. Subsea snubbing is a heavy duty well intervention with more conventional drill pipe, instead of wireline or coiled tubing, which are other tubular members in subsea systems. The subsea location of the well requires the snubbing unit to be further specialized for withstanding the underwater conditions, such as heave compensation, and providing the force and pressure necessary to push pipe or snub into the well.

Various patents and publications disclose technology related to snubbing units and accessory devices for snubbing units.

U.S. Pat. No. 6,116,345, issued to Fontana et al on Sep. 12, 2000, discloses a prior art tubing injection system for land and underwater wells. A first injector at the wellbore on land or on the ocean floor pushes pipe or coiled tubing into the well. A second injector transfers the pipe or coiled tubing from a storage location to the first injector.

U.S. Pat. No. 6,854,520, issued to Robichaux on Feb. 15, 2005, describes a baseline prior art apparatus and method for handling a tubular. The apparatus attaches two sets of slips to a tubular member, and one set of slips can move closer or farther from the other set of slips.

United States Patent Publication No. 20070084606, published for Ponville on Apr. 19, 2007, teaches a rig assist compensation system. The snubbing jack has a base frame to compensate for heave, when the snubbing jack is on a rig. Vertical movement of the rig is balanced by base frame so that the snubbing is not disrupted. The base frame provides stability to the snubbing unit.

United States Patent Publication No. 20060078390, published for Olsen et al on Apr. 13, 2006, teaches another heave compensated snubbing system. A piston connects to the traveling slip of the snubbing unit. The piston is releasably engaged to the floating platform, so that a disengaged position allows the traveling slip to move independent from vertical movement of the floating platform.

Besides heave compensation, another problem with snubbing tubular members, such as pipe, is buckling. There is typically an unsupported length of the tubular member between the traveling slip bowls and the standing or stationary slip bowls of the snubbing unit. When the traveling slip bowls or slips push downward, this unsupported length of tubular member is in compression, and may be prone to buckling. Conventional anti-buckling guides for pipe on land are not compatible with underwater conditions and remoteness of the sea floor. Furthermore, for subsea production systems, snubbing coiled tubing, instead of more conventional pipe is desirable. Coiled tubing is even more susceptible to buckling because of the different material composition and relatively smaller diameter compared to conventional pipe. The buckling concern is a serious obstacle for snubbing coiled tubing.

United States Patent Publication No. 20120006565, published for McKinnon et al on Jan. 12, 2012, describes a pipe guide for a snubbing unit. The pipe guide has an adjustable collar to brace the pipe between the traveling slips and the stationary slips of the snubbing unit. The pipe guide has a frame that moves in coordination with the traveling slips of the snubbing jack.

It is an object of the present invention to provide a guide apparatus to prevent buckling of a tubular member snubbing into a well.

It is an object of the present invention to provide a guide apparatus to prevent buckling of a tubular member in a subsea well with a subsea snubbing unit.

It is another object of the present invention to provide a guide apparatus to prevent buckling of a tubular member between the traveling slip bowls and stationary slip bowls of a snubbing unit.

It is an object of the present invention to provide a guide apparatus for a snubbing unit to brace the unsupported length of a tubular member between the traveling slip bowls and stationary slip bowls of the snubbing unit.

It is an object of the present invention to provide a guide apparatus for a snubbing unit for use with coiled tubing.

These and other objects and advantages of the present invention will become apparent from a reading of the attached specification and appended claims.

BRIEF SUMMARY OF THE INVENTION

Embodiments of the guide apparatus of the present invention relates to tubular members, such as pipe, coiled tubing and wireline. The guide apparatus can be cooperative with a snubbing unit and can be used at remote subsea locations. The guide apparatus protects the tubular member or pipe during a snubbing operation to prevent buckling of the tubular member or pipe. In some embodiments, the guide apparatus includes a lower slotted cylinder and an upper slotted cylinder. The lower slotted cylinder has a bottom base ring on a bottom base end and a plurality of rib extensions projecting upward from the bottom base ring to an extension tip end and forming lower slots. The upper slotted cylinder has an upper base ring on a top base end and a plurality of complementary rib extensions projecting downward from the upper base ring to a complementary extension tip end and forming upper slots.

The lower slotted cylinder engages the upper slotted cylinder so that the rib extensions slide between the complementary rib extensions, when the top base end moves toward the bottom base end. The lower slots formed by the rib extensions of the lower slotted cylinder are aligned with the complementary rib extensions of the upper slotted cylinder. The upper slots formed by the complementary rib extensions of the upper slotted cylinder are aligned with the rib extensions of the lower slotted cylinder. There can be an expanded configuration, a condensed configuration, and a transitional configuration as the cylinders move between the expanded configuration and the condensed configuration. The actuation of the cylinders is coordinated with action of a snubbing unit, so that the tubular member is protected, when the snubbing unit inserts the tubular member through the well. The tubular member extends through both of the slotted cylinders of the guide apparatus. The rib extensions and the complementary rib extensions have shapes and surfaces to engage and brace the tubular member, preventing buckling along the entire length between the slip bowls of the snubbing unit. In some embodiments, at least a portion of the length of tubular member is supported by only the rib extensions, only the complementary rib extensions, or both rib extensions between the slip bowls of the snubbing unit.

Another embodiment of the guide apparatus has the portion of the length of tubular member between the slip bowls always being supported by the rib extensions and sometimes both rib extensions and complementary rib extensions. In this embodiment the upper slotted cylinder is mounted between the extension tip end and the bottom base end of the lower slotted cylinder. The rib extensions pass through the upper base ring and the entire upper slotted cylinder. The complementary rib extensions maintain the same relationship to the rib extensions, even as the rib extensions pass through the upper base ring. For this embodiment, the snubbing unit engages the upper slotted cylinder with the traveling slip bowls of the snubbing unit. The movement of the traveling slip bowls matches the upper slotted cylinder. The tubular member is supported along the entire length between the traveling slip bowls and the stationary slip bowls of the snubbing unit by the rib extensions of the lower slotted cylinder. A portion of the tubular member is also supported by both the rib extensions and the complementary rib extensions.

Further embodiments of the present invention include the assembly of a snubbing unit and a guide apparatus. In the assembly, the snubbing unit includes a set of stationary slip bowls in a first base plate, a set of traveling slip bowls in a second base plate, and a plurality of hydraulic cylinders connecting said first base plate to said second base plate. Actuation of the hydraulic cylinders corresponds to movement of the second base plate relative to the first base plate. The snubbing action is the gripping of the tubular member at the traveling slip bowls to insert the tubular member into the well below the first base plate. The gripping at the stationary slip bowls at the first base plate maintains the tubular member in the well under pressure. For this snubbing unit, the guide apparatus incorporates the first base plate and the bottom base end of the lower slotted cylinder, setting the orientation of both slotted cylinders of the guide apparatus. As such, the top base end of the upper slotted cylinder is fixed to the traveling slip bowls, so that movement of the complementary rib extensions matches movement of the traveling slip bowls.

Embodiments can also include a support plate between the first base plate and the second base plate of the snubbing unit. The support plate can support alignment of the slotted cylinders of the guide apparatus and the hydraulic cylinders of the snubbing unit. The tubular member is also aligned with the support plate, since the tubular member is within the slotted cylinders of guide apparatus and along the same central axis.

DETAILED DESCRIPTION OF THE INVENTION

Figure 1:
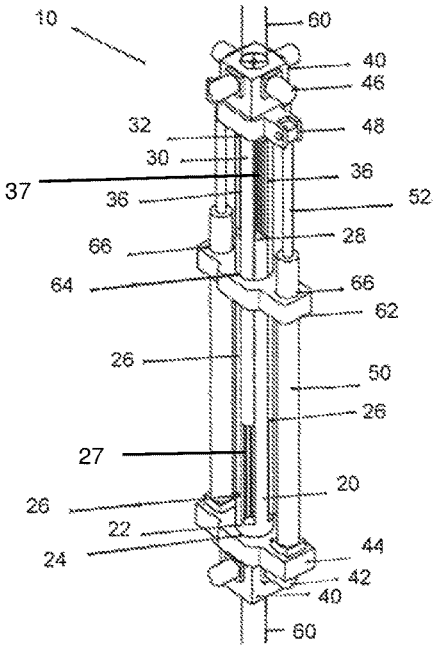
FIG. 1 is a perspective view of a first embodiment of the guide apparatus of the present invention.
Figure 2:
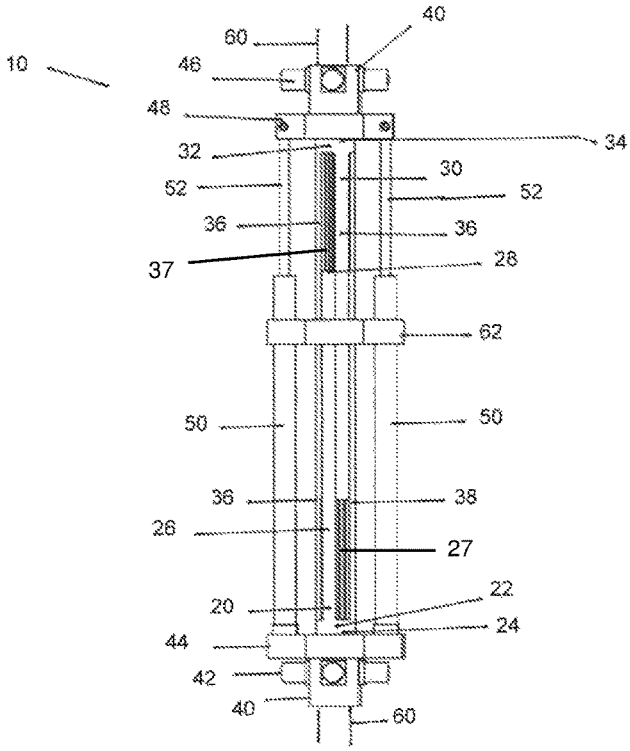
FIG. 2 is a front elevation view of the embodiment of FIG. 1.
Figure 3:
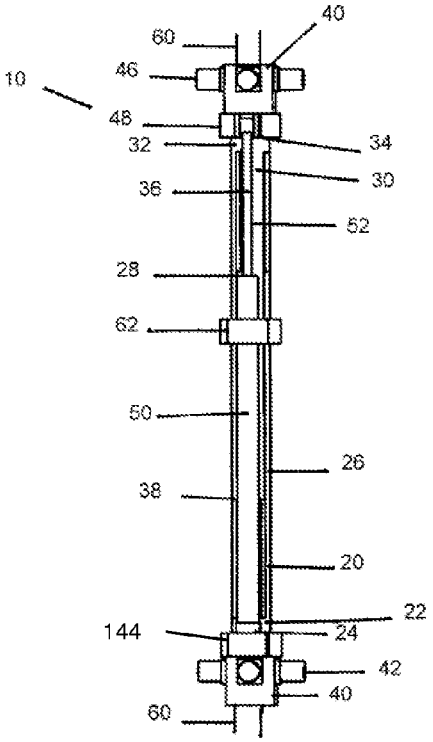
FIG. 3 is a side elevation view of the embodiment of FIG. 1.

Referring to FIGS. 1-3, an embodiment of the guide apparatus 10 is compatible with a snubbing unit. A tubular member, such as a pipe, coiled tubing or wireline, is pushed into a well under pressure by the snubbing unit. The guide apparatus prevents buckling of the tubular member, during the snubbing operation. The guide apparatus 10 protects the tubular along the entire length of tubular member in the snubbing unit. FIGS. 1-3 show the lower slotted cylinder 20 and the upper slotted cylinder 30. The lower slotted cylinder 20 comprises a bottom base ring 22 on a bottom base end 24 and a plurality of rib extensions 26 projecting upward from the bottom base ring 22 to an extension tip end 28. Lower slots 27 are formed between adjacent rib extensions 26. The upper slotted cylinder 30 comprises an upper base ring 32 on a top base end 34 and a plurality of complementary rib extensions 36 projecting downward from the upper base ring 32 to a complementary extension tip end 38. Upper slots 37 are formed between adjacent complementary rib extensions 36.

FIGS. 1-3 show the lower slotted cylinder 20 engaging the upper slotted cylinder 30 by sliding the rib extensions 26 into the upper slots 37 between the complementary rib extensions 36. The lower slots 27 between the rib extensions 26 align with the complementary rib extensions 36, and the upper slots 37 between the complementary rib extensions 36 align with the rib extensions 26. When the top base end 34 moves toward the bottom base end 24, the extension tip end 28 slides past the complementary extension tip end 38. The rib extensions 26 and the complementary rib extensions 36 interlock and alternate, when they overlap as the top base end 34 moves toward the bottom base end 24. Portions of the tubular member within the guide apparatus 10 are circumscribed by alternating rib extensions 26 and complementary rib extensions 36. Other portions are supported by either rib extensions 26 or complementary rib extensions 36.

In an expanded configuration of the lower slotted cylinder 20 and the upper slotted cylinder 30, the extension tip end 28 faces the complementary extension tip end 38. The bottom base end 22 is the furthest distance from the top base end 32. The rib extensions 26 are aligned with the upper slots 37, and the complementary rib extensions 36 are aligned with the lower slots 27. In a condensed configuration with the extension tip end 28 adjacent the top base end 32 and the complementary tip end 38 adjacent the bottom base end 22, the distance between the bottom base end 22 and the top base end 32 is the smallest. The rib extensions 26 fit into the upper slots 37, and the complementary rib extensions 36 fit into the lower slots 27. The rib extensions 26 alternate with the complementary rib extensions 36 around a central axis of the guide apparatus 10. In the transitional configuration between the expanded configuration and the condensed configuration, the rib extensions 26 partially alternate or interlock with the complementary rib extensions 36. The rib extensions 26 partially fit into the upper slots 37, and the complementary rib extensions 36 partially fit in the lower slots 27, according to the distance between the top base end 32 and the bottom base end 22. The actuation between the expanded configuration to the condensed configuration can correspond to one stroke of a snubbing unit.

The rib extensions 26 and complementary rib extensions 36 are cooperative. The rib extensions 26 can have a cross-sectional shape as a ring section or a wedge with a curved outer surface and a similarly curved inner surface. The curved inner surface faces and abuts the pipe or tubular member inserting through the guide apparatus 10. The curvature of the curved inner surface is compatible with the pipe or tubular member. This curvature can be adjusted for different pipes or tubular members. The complementary rib extensions 36 can have the nearly identical features with an inverted orientation from the top base end 32. When the rib extensions 26 and complementary rib extensions 36 alternate, the curved inner surfaces form a generally continuous interior surface around the central axis. A tubular member is supported and braced by the continuous interior surface formed by the rib extensions 26 and complementary rib extensions 36, as the tubular member moves through the guide apparatus 10. The continuous interior surface is formed with the rib extensions 26 and complementary rib extensions 36 alternated with some overlap of the rib extensions 26 and complementary rib extensions 36 as the bottom base end 22 and the top base end 32 move closer together. In some embodiments, curved outer surfaces form a generally continuous exterior surface around the central axis. Other attachments can be used to support this exterior surface as the interior surface braces the tubular member. FIGS. 1-3 show embodiments with four rib extensions 26 and four complementary rib extensions 36. The pipe or tubular member is supported by at least four rib extensions 26, 36 along the entire length of the snubbing unit.

FIGS. 1-3 also disclose an embodiment of the present invention as an assembly of the guide apparatus 10 and a snubbing unit 40. In this embodiment, the snubbing unit 40 includes a set of stationary or static slip bowls 42 in a first base plate 44, a set of traveling slip bowls 46 in a second base plate 48, and a plurality of hydraulic cylinders 50 connecting the first base plate 44 to the second base plate 48. The hydraulic cylinders 50 can also have cylinder rods 52 for actuation of the second base plate 48 towards the first base plate 44. The hydraulic cylinders 50 coordinate movement of the second base plate 48 relative to the first base plate 44. A tubular member 60 inserts through the snubbing unit 40 from the second base plate 48 to the first base plate 44. The guide apparatus 10 sets between the first base plate 44 and the second base plate 48 so that the tubular member 60 also inserts through the guide apparatus 10. The rib extensions 26 maintain alignment and prevent buckling of the tubular member 60 for at least a portion of the length of the tubular member 60 between the slip bowls 42 and 46. The complementary rib extensions 36 maintain alignment and prevent buckling of the tubular member 60 for at least a portion of the length of the tubular member 60 between the slip bowls 42 and 46. Along some portions, both the rib extensions 26 and the complementary rib extensions 36 together maintain alignment and prevent buckling of the tubular member 60. The portion protected by the rib extensions 26 and 36 depends upon the guide apparatus 10 being in the expanded configuration, the condensed configuration or transitional configuration between these configurations.

The tubular member 60 inserts through the guide apparatus 10 along the central axis within the rib extensions 26 and the complementary rib extensions 36. The bottom base end 22 of the guide apparatus 10 engages the first base plate 44, and the upper base end 32 of the guide apparatus 10 engages the second base plate 48. Movement of the set of traveling slip bowls 46 in the second base plate 48 relative to the set of static slip bowls 42 in the first base plate 44 corresponds to movement of the guide apparatus 10 between the expanded configuration, the transitional configuration, and the condensed configuration. In some embodiments, one stroke of the snubbing unit 40 corresponds to one cycle of the guide apparatus between the expanded configuration to the condensed configuration. The relationship of the rib extensions 26 and complementary rib extensions 36 remain cooperative and now coordinated with the snubbing unit 40 and actuation of the hydraulic cylinders 50 to set the distance between the first base plate 44/lower slotted cylinder 20 and the second base plate 48/upper slotted cylinder 30. The continuous interior surfaces and respective curved inner surfaces of each rib extension 26 and each complementary rib extension 36 support and brace the tubular member 60 through both the snubbing unit 40 and the guide apparatus 10.

Some embodiments include a snubbing unit 40 with a support plate 62 between the first base plate 44 and the second base plate 48. The support plate 62 can have a center hole 64, and a plurality of side holes 66. The center hole 64 aligns with the lower slotted cylinder 20 and the upper slotted cylinder 30. The side holes 66 align with the hydraulic cylinders 50. The hydraulic cylinders 50 insert through the support plate 62 so that the support plate 62 is mounted in a fixed position on the hydraulic cylinders 50. The rib extensions 26 and the complementary rib extensions 36 are aligned with the center hole 66 so as to be insertable through the center hole 66. The rib extensions 26 and complementary rib extensions 36 are positioned to pass through the center hole 66 separately or when alternating within corresponding lower slots 27 and upper slots 37. Similarly, the tubular member 60 is aligned to pass through the center hole 66 and within the rib extensions 26, the complementary rib extensions 36, or both. The rib extensions 26 and complementary rib extensions 36 are further cooperative with the support plate 62 for bracing the tubular member 60. With each rib extensions 26 and each complementary rib extension 36, the respective curved outer surfaces form a generally continuous exterior surface around the central axis. The support plate 62 is an embodiment of another attachment used to support this exterior surface as the interior surface braces the tubular member 60. The support plate 62, rib extensions 26 and complementary rib extensions 36 can all brace the tubular member 60 in the center hole 66.

Referring to FIGS. 4A, 4B, 5 and 6, an alternate embodiment of the guide apparatus 110 is compatible with a snubbing unit. The guide apparatus 100 still prevents buckling of the tubular member, during the snubbing operation and still protects the tubular along the entire length of tubular member through the snubbing unit. FIGS. 4A, 4B, 5 and 6 show the lower slotted cylinder 120 and the upper slotted cylinder 130. The lower slotted cylinder 120 comprises a bottom base ring 122 on a bottom base end 124 and a plurality of rib extensions 126 projecting upward from the bottom base ring 122 to an extension tip end 128. Lower slots 127 are formed between adjacent rib extensions 126. The upper slotted cylinder 130 comprises an upper base ring 132 on a top base end 134 and a plurality of complementary rib extensions 136 projecting downward from the upper base ring 132 to a complementary extension tip end 138. Upper slots 137 are formed between adjacent complementary rib extensions 136.

FIGS. 4A, 4B, 5 and 6 show the lower slotted cylinder 120 engaging the upper slotted cylinder 130 by sliding the rib extensions 126 between the complementary rib extensions 136. The lower slots 127 between the rib extensions 126 align with the complementary rib extensions 136, and the upper slots 137 between the complementary rib extensions 136 align with the rib extensions 126. In this embodiment, the rib extensions 126 also pass through the entire upper slotted cylinder 130, including the upper base ring 132. The upper slotted cylinder 130 is mounted between the bottom base end 122 and the extension tip end 128 of the lower slotted cylinder 20. The upper slotted cylinder 130 aligns on the rib extensions 126 as if the rib extensions 126 were rails. When the top base end 134 moves toward the bottom base end 124, the upper base end 132 and the complementary extension tip end 138 are oriented along the rib extensions 126. The rib extensions 126 and the complementary rib extensions 136 still interlock and alternate. At least a portion of the tubular member within the guide apparatus 110 is circumscribed by alternating rib extensions 126 and complementary rib extensions 136.

In a first configuration, the extension tip end 128 remains above the upper slotted cylinder 130, but the top base end 132 is closest to the extension tip end 128. The bottom base end 122 is the furthest distance from the top base end 132, when the upper slotted cylinder 130 is almost adjacent to the extension tip end 128. The rib extensions 126 are aligned with the upper slots 137, and the complementary rib extensions 136 are aligned with the lower slots 127. In a second configuration, the complementary extension tip end 138 is closest to the bottom base end 122, the distance between the bottom base end 122 and the top base end 132 being the smallest. The bottom base end 122 is the closest to the top base end 132. The lower slotted cylinder 120 and the upper slotted cylinder 130 actuate between the first and second configuration. The complementary rib extensions 136 always remain within the lower slots 127 and alternating with the rib extensions 126. The complementary rib extensions 136 are shorter that the rib extensions 126, so that there are remaining portions of the rib extensions 126 only between the extension tip end 128 and bottom base end 122. The actuation of this embodiment between the first configuration and the second configuration can still correspond to one stroke of the snubbing unit.

The rib extensions 126 and complementary rib extensions 136 are cooperative as in previous embodiments. The rib extensions 126 and complementary rib sections 136 can have compatible cross-sectional shapes and curved inner surfaces corresponding to the pipe or tubular member inserting through the guide apparatus 110. This curvature can be adjusted for different pipes or tubular members. The continuous interior surface can brace a tubular member within the rib extensions 126 and complementary rib extensions 136. FIGS. 4A, 4B, 5 and 6 show embodiments with four rib extensions 126 and four complementary rib extensions 136. The pipe or tubular member is supported by at least four rib extensions 126 along the entire length of the snubbing unit 140 and by the alternating and interlocked rib extensions 126 and complementary rib extensions 136 along at least a portion of the entire length of the snubbing unit 140 and along an entire length of the upper slotted cylinder 130.

Figure 4A:
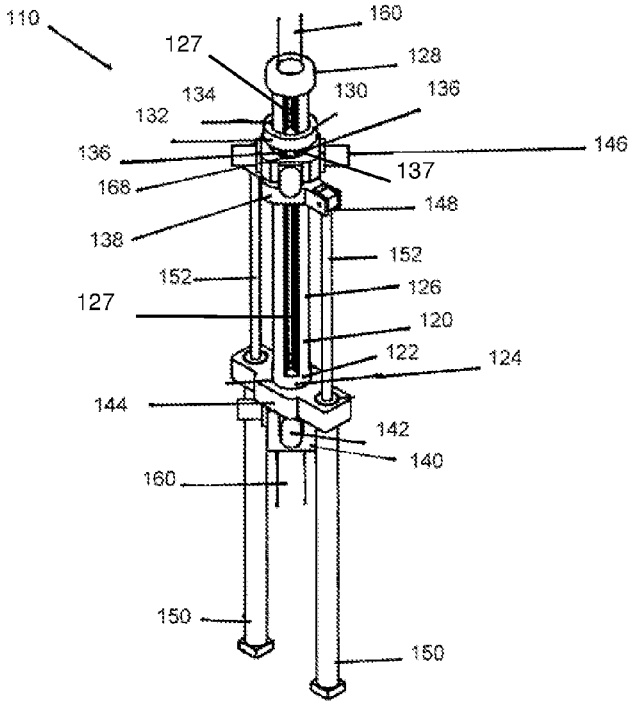
FIG. 4A is a perspective view of a second embodiment of the guide apparatus of the present invention.
Figure 4B:
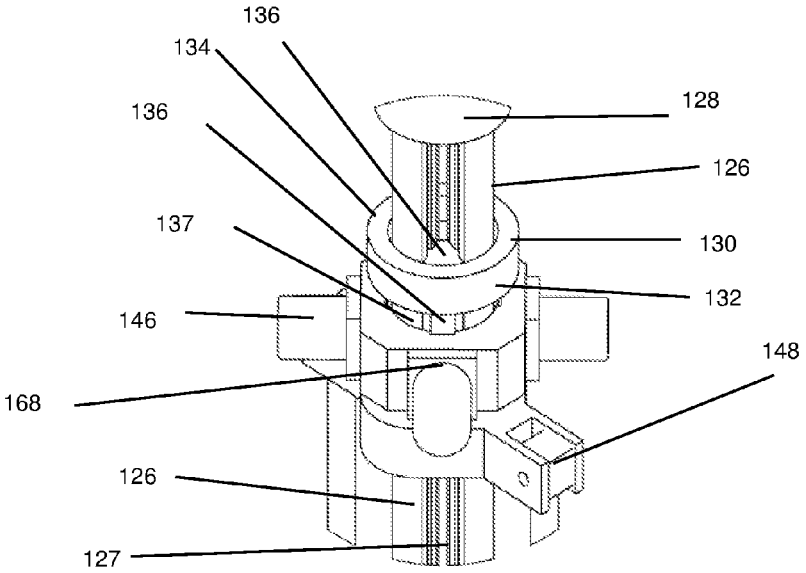
FIG. 4B is an enlarged perspective view of the embodiment of FIG. 4A.
Figure 5:
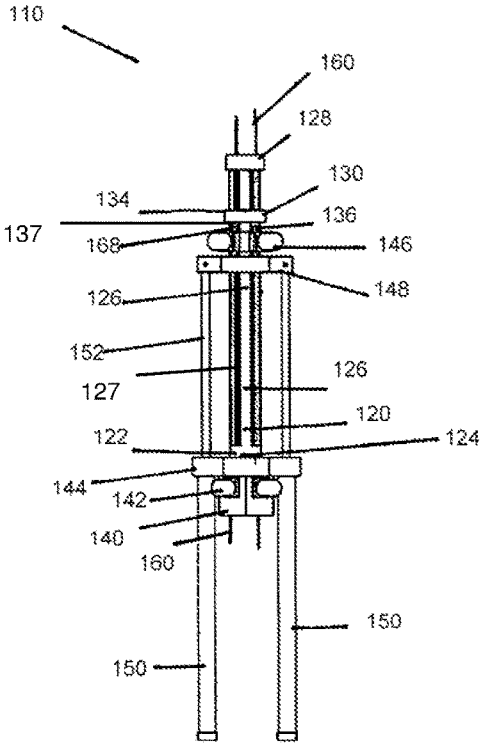
FIG. 5 is a front elevation view of the embodiment of FIG. 4.
Figure 6:
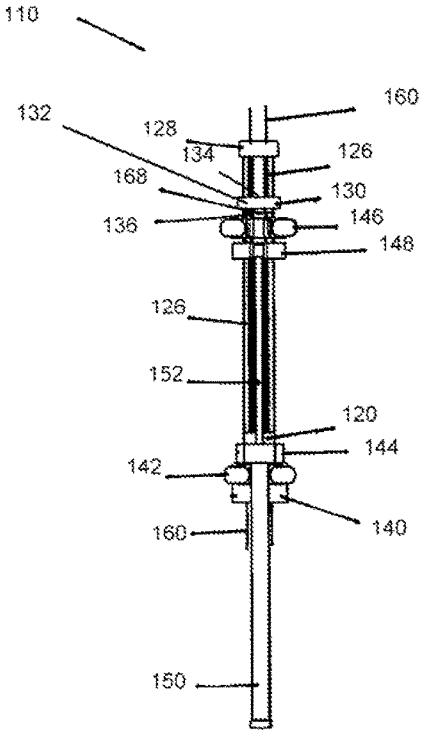
FIG. 6 is a side elevation view of the embodiment of FIG. 4.

FIGS. 4A, 4B, 5 and 6 also disclose an embodiment of the present invention as another assembly of the guide apparatus 110 and a snubbing unit 140. In this embodiment, the snubbing unit 140 includes a set of stationary slip bowls 142 in a first base plate 144, a set of traveling slip bowls 146 in a second base plate 148, and a plurality of hydraulic cylinders 150 connecting the first base plate 144 to the second base plate 148. The hydraulic cylinders 150 can also have cylinder rods 152 for actuation of the second base plate 148 towards the first base plate 144. FIGS. 4-6 show the hydraulic cylinders 150 extending beneath the first base plate 144. The embodiment of FIGS. 4A, 4B, 5 and 6 is more compact and requires less space than other embodiments. The full stroke of the snubbing unit 140 is only the length of the lower slotted cylinder 120, instead of the other embodiment spanning the lower slotted cylinder 20 and the upper slotted cylinder 30.

A tubular member 160 inserts through the snubbing unit 140 from the second base plate 148 to the first base plate 144. The guide apparatus 110 sets above the first base plate 144 and through the second base plate 148 so that the tubular member 160 inserts along the central axis of the guide apparatus 110 and through the guide apparatus 110 at the extension tip end 128 before the second base plate 148. The bottom base end 122 engages the first base plate 144, and the upper base end 132 engages the second base plate 148. Movement of the set of traveling slip bowls 146 in the second base plate 148 relative to the set of static slip bowls 142 in the first base plate 144 corresponds to movement of the guide apparatus 110 between the first configuration and the second configuration.

The rib extensions 126 maintain alignment and prevent buckling of the tubular member 160 for the entire length of the tubular member 160 between the slip bowls 142 and 146. The rib extensions 126 also protect above the traveling slip bowls 146. The complementary rib extensions 136 maintain alignment and prevent buckling of the tubular member 160 for at least a portion of the length of the tubular member 160. FIGS. 4A, 4B, 5 and 6 show the upper slotted cylinder 130 removably attached to the traveling slip bowls 146. As the traveling slip bowls 146 move, the upper slotted cylinder 130 and complementary rib extensions 136 also move. The interlocked and alternating rib extensions 126, 136 are still cooperative. The continuous interior surface formed by the rib extensions 126 and the complementary rib extensions 136 moves according to the traveling slip bowls 146. Both the rib extensions 126 and the complementary rib extensions 136 together maintain alignment and prevent buckling of the tubular member 160 along the length of the upper slotted cylinder 130. The portion protected by the only rib extensions 126 depends upon position of the guide apparatus 110 being the first configuration and the second configuration. The rib extensions 126 are longer than the complementary rib extensions 136. The length of the shorter complementary rib extensions 136 determines the continuous interior surface bracing and abutting the tubular member 160. The rib extensions 126 are longer than one stroke of the snubbing unit 140 in this embodiment. Movement of the upper slotted cylinder 130 along the rib extensions 126 of the lower slotted cylinder 120 can be matched to one stroke of the snubbing unit.

FIG. 4A shows how another embodiment can include a snubbing unit 140 with a support plate (not shown) analogous to the support plate 62 of FIGS. 1-3. The support plate (not shown) can similarly have a center hole and a plurality of side holes. The center hole aligns with the lower slotted cylinder 120. The side holes align with the hydraulic cylinders 150 and/or cylinder rods 152. The hydraulic cylinders 150 insert through the first base plate 144 so that the first base plate 144 is mounted in a fixed position on the cylinder rods 152. The cylinder rods 152 similarly pass through the side holes of the support plate for additional bracing and mechanical support between the traveling slip bowls 146 and the static slip bowls 142. The support plate can provide extra support to the guide apparatus 110 during the stroke of the snubbing unit 140.

FIGS. 4A, 4B, 5 and 6 also show an embodiment with the removeable attachment of the upper slotted cylinder 130 to the traveling slip bowls 146. The set of traveling slip bowls 146 engages the upper slotted cylinder 130. Each traveling slip 146 engages the tubular member 160 through each complementary rib extension 136. There is a through hole 168 in each complementary rib extension 136, shown as a rectangular slot in FIG. 6. The set of traveling slip bowls 146 are segmented to engage through each through hole 168. The traveling slip bowls 146 and the upper slotted cylinder 130 move together relative to the lower slotted cylinder 120, when the traveling slip bowls 146 engage the tubular member 160.

The guide of the present invention prevents buckling of a tubular member snubbing into a well. The entire length of the tubular member between the traveling slip bowls and stationary slip bowls of the snubbing unit is protected by the rib extensions, the complementary rib extensions, or both. The rib extensions maintain alignment of the tubular member by bracing and forming an interior surface abutting the tubular member as the tubular member slides past. The complementary rib extensions maintain alignment of the tubular member by bracing and forming an interior surface abutting the tubular member as the tubular member slides past. Both the rib extensions and the complementary rib extensions can alternate and together maintain alignment of the tubular member by bracing and forming a continuous interior surface abutting the tubular member as the tubular member slides past. There is no unsupported length of the tubular member in the present invention. Conventional pipe or even coiled tubing can be snubbed with the present invention. The rib extensions, complementary rib extensions, or both interlocked and alternating rib extensions brace the tubular member between the slip bowls to prevent buckling, when the pipe or tubular member is pushed into the well under pressure. The guide apparatus is particularly useful for preventing buckling of a tubular member in a subsea well with a subsea snubbing unit. Subsea conditions and the remote location of the well are not compatible with conventional anti-buckling technology. The guide apparatus of the present invention includes different structures and relationships between the slip bowls, slotted cylinders, and end plates.

As described herein, the invention provides a number of advantages and uses; however such advantages and uses are not limited by such description. Embodiments of the present invention are better illustrated with reference to the Figure(s), however, such reference is not meant to limit the present invention in any fashion. The embodiments and variations described in detail herein are to be interpreted by the appended claims and equivalents thereof.

The foregoing disclosure and description of the invention is illustrative and explanatory thereof. Various changes in the details of the described method can be made without departing from the true spirit of the invention.

We claim:

1. A guide apparatus, comprising:

a) a lower slotted cylinder, comprising:
   i) a bottom base end;
   ii) a bottom base ring disposed on the bottom base end;
   iii) a plurality of adjacent lower slotted cylinder rib extensions projecting upward from the bottom base ring to a lower slotted cylinder extension tip end, each lower slotted cylinder rib extension comprising a curved outer surface; and
   iv) a set of lower slotted cylinder slots defined intermediate each pair of adjacent lower slotted cylinder rib extensions; and b) an upper slotted cylinder adapted to engage the lower slotted cylinder, the upper slotted cylinder comprising:
   i) an upper base ring disposed on a top base end; and
   ii) a plurality of upper slotted cylinder rib extensions projecting downward from the upper base ring to a upper slotted cylinder extension tip end, each upper slotted cylinder rib extension comprising a curved outer surface which is complementary to the lower slotted cylinder rib extension curved outer surface;
   iii) a set of upper slotted cylinder slots defined by each pair of adjacent upper slotted cylinder rib extensions intermediate that pair of adjacent upper slotted cylinder rib extensions, the lower slotted cylinder extension tip end being slideable past the upper slotted cylinder extension tip end, a set of the upper slotted cylinder rib extensions slidably disposed between a corresponding set of the upper slotted cylinder rib extensions when the top base end moves toward the bottom base end;

c) wherein the lower slotted cylinder and the upper slotted cylinder comprise:

i) an expanded configuration, comprising the lower slotted cylinder extension tip end facing the upper slotted cylinder extension tip end when the bottom base end is at a furthest displacement from the top base end, the lower slotted cylinder rib extensions are aligned with the upper slotted cylinder slots, and the slotted cylinder rib extensions are aligned with the lower slotted cylinder slots;

ii) a separate, condensed configuration traversable from the expanded configuration in a single stroke of a snubbing unit, the separate, condensed configuration comprising the lower slotted cylinder extension tip end disposed adjacent the top base end and the upper slotted cylinder tip end disposed adjacent the bottom base end when the lower slotted cylinder rib extensions alternate with the upper slotted cylinder rib extensions around a central axis, the upper slotted cylinder rib extensions are disposed into the upper slotted cylinder slots, the upper slotted cylinder rib extensions are disposed into the lower slotted cylinder slots; and iii) a transitional configuration between the expanded configuration and the condensed configuration when the lower slotted cylinder rib extensions are partially alternated with the upper slotted cylinder rib extensions around the central axis, the lower slotted cylinder rib extensions are partially disposed into the upper slotted cylinder slots, and the lower slotted cylinder rib extensions are partially disposed into the lower slots.

2. The guide apparatus of claim 1, wherein the transitional configuration is dependent on a distance between the top base end and the bottom base end.

3. The guide apparatus of claim 1, wherein:

a) the plurality of lower slotted cylinder rib extensions comprise four wedges; and b) the plurality of upper slotted cylinder rib extensions comprise four complementary wedges.

4. The guide apparatus of claim 1, wherein the lower slotted cylinder rib extensions and the upper slotted cylinder rib extensions form a generally continuous exterior surface in the condensed configuration and in the transition configuration when the lower slotted cylinder rib extensions and the upper slotted cylinder rib extensions alternate around the central axis.

5. The guide apparatus of claim 1, wherein:

a) each lower slotted cylinder rib extension comprises a curved inner surface; and b) each upper slotted cylinder rib extension comprises a complementary curved inner surface, the lower slotted cylinder rib extensions and the upper slotted cylinder rib extensions forming a generally continuous interior surface in the condensed configuration and in the transition configuration when the lower slotted cylinder rib extensions and the upper slotted cylinder rib extensions alternate around the central axis.

6. The guide apparatus of claim 5, wherein the continuous interior surface comprises a shape to allow displacement adjacent a tubular member in the snubbing unit.

7. An assembly for inserting tubular members, comprising:

a) a guide apparatus comprising:

i) a lower slotted cylinder, comprising:

(1) a bottom base end;

(2) a bottom base ring on the bottom base end; and (3) a plurality of adjacent lower slotted cylinder rib extensions projecting upward from the bottom base ring to a lower slotted cylinder extension tip end, each lower slotted cylinder rib extension comprising a curved outer surface; and (4) a set of lower slotted cylinder slots defined intermediate each pair of adjacent lower slotted cylinder rib extensions; and ii) an upper slotted cylinder adapted to engage the lower slotted cylinder, the upper slotted cylinder comprising:

(1) an upper base ring on a top base end; and (2) a plurality of upper slotted cylinder rib extensions projecting downward from the upper base ring to a upper slotted cylinder extension tip end, each upper slotted cylinder rib extension comprising a curved outer surface which is complementary to the lower slotted cylinder rib extension curved outer surface;

(3) a set of upper slotted cylinder slots defined by each pair of adjacent upper slotted cylinder rib extensions intermediate that pair of adjacent upper slotted cylinder rib extensions, the lower slotted cylinder extension tip end being slideable past the upper slotted cylinder extension tip end, a set of the upper slotted cylinder rib extensions slidably disposed between a corresponding set of the upper slotted cylinder rib extensions when the top base end moves toward the bottom base end;

iii) the lower slotted cylinder and the upper slotted cylinder comprising:

(1) an expanded configuration, comprising the lower slotted cylinder extension tip end facing the upper slotted cylinder extension tip end when the bottom base end is at a furthest displacement from the top base end, the lower slotted cylinder rib extensions are aligned with the upper slotted cylinder slots, and the slotted cylinder rib extensions are aligned with the lower slotted cylinder slots;

(2) a separate, condensed configuration traversable from the expanded configuration in a single stroke of a snubbing unit, the separate, condensed configuration comprising the lower slotted cylinder extension tip end disposed adjacent the top base end and the upper slotted cylinder tip end disposed adjacent the bottom base end when the lower slotted cylinder rib extensions alternate with the upper slotted cylinder rib extensions around a central axis, the upper slotted cylinder rib extensions are disposed into the upper slotted cylinder slots, the upper slotted cylinder rib extensions are disposed into the lower slotted cylinder slots; and (3) a transitional configuration between the expanded configuration and the condensed configuration when the lower slotted cylinder rib extensions are partially alternated with the upper slotted cylinder rib extensions around the central axis, the lower slotted cylinder rib extensions are partially disposed into the upper slotted cylinder slots, and the lower slotted cylinder rib extensions are partially disposed into the lower slots, according to a distance between the lower slotted cylinder and the upper slotted cylinder;

b) a snubbing unit, comprising:

i) a set of stationary slip bowls disposed in a first base plate;

ii) a set of traveling slip bowls disposed in a second base plate, the guide apparatus disposed intermediate the first base plate and the second base plate; and iii) a plurality of hydraulic cylinders connecting the first base plate to the second base plate, the plurality of hydraulic cylinders actuatable by movement of the second base plate relative to the first base plate, the movement of the set of traveling slip bowls in the second base plate relative to the set of stationary slip bowls in the first base plate corresponding to movement of the lower slotted cylinder and the upper slotted cylinder between the expanded configuration, the transitional configuration, and the condensed configuration; and c) a tubular member disposed through the snubbing unit intermediate the second base plate and the first base plate.

8. The assembly of claim 7, wherein the lower slotted cylinder and the upper slotted cylinder actuating between the expanded configuration and the condensed configuration corresponds to one stroke of the snubbing unit.

9. The assembly of claim 7, wherein:

a) the plurality of lower slotted cylinder rib extensions comprise four wedges; and b) the plurality of upper slotted cylinder rib extensions comprise four complementary wedges.

10. The guide apparatus of claim 7, wherein:

a) each lower slotted cylinder rib extension comprises a curved inner surface; and b) each upper slotted cylinder rib extension comprises a complementary curved inner surface, the lower slotted cylinder rib extensions and the upper slotted cylinder rib extensions forming a generally continuous interior surface in the condensed configuration and in the transition configuration when the lower slotted cylinder rib extensions and the upper slotted cylinder rib extensions alternate around the central axis.

11. The guide apparatus of claim 10, wherein the continuous interior surface comprises a shape to allow displacement adjacent a tubular member in the snubbing unit.

12. The assembly of claim 7, further comprising:

a) a support plate disposed intermediate the first base plate and the second base plate and attached to the hydraulic cylinders, the hydraulic cylinders inserted at least partially through the support plate, the support plate comprising i) a center hole aligned with the lower slotted cylinder and the upper slotted cylinder, each lower slotted cylinder rib extension and each upper slotted cylinder rib extension aligned to pass through the center hole, the tubular member aligned to pass within the lower slotted cylinder rib extensions and the upper slotted cylinder rib extensions through the center hole; and ii) a plurality of side holes, each side hole aligned with a corresponding hydraulic cylinder of the snubbing unit.

13. The assembly of claim 12, wherein:

a) each lower slotted cylinder rib extension comprises a curved outer surface;

b) each upper slotted cylinder rib extension comprises a complementary curved outer surface, the lower slotted cylinder rib extensions and the upper slotted cylinder rib extensions forming a generally continuous exterior surface in the condensed configuration and in the transition configuration when the lower slotted cylinder rib extensions and the upper slotted cylinder rib extensions alternate around the central axis, each curved outer surface and complementary curved outer surface disposed through the center hole of the support plate; and c) the center hole is configured to support the continuous exterior surface.

14. A guide apparatus, comprising:

a) a lower slotted cylinder, comprising:

i) a bottom base end;

ii) a bottom base ring disposed on the bottom base end; and iii) a plurality of rib extensions projecting upward from the bottom base ring to an extension tip end, each adjacent pair of the plurality of rib extensions forming a lower slot between the adjacent pair of rib extensions; and b) an upper slotted cylinder configured to selectively engage the lower slotted cylinder, the upper slotted cylinder comprising:

i) an upper base ring disposed on a top base end, the top base end moveable with respect to the lower base end along a central axis defined through a center of the top base end and the bottom base end; and ii) a plurality of complementary rib extensions projecting downward from the upper base ring to a complementary extension tip end, the plurality of complementary rib extensions forming upper slots between pairs of adjacent complementary rib extensions, the complementary rib extensions slidable between the rib extensions when the top base end moves between the extension tip end and the bottom base end of the lower slotted cylinder, the complementary rib extensions extending through the upper base ring, c) wherein:

i) the lower slotted cylinder and the upper slotted cylinder comprise a first configuration and a second configuration, the lower slotted cylinder and the upper slotted cylinder actuating between the first configuration and the second configuration corresponding to one stroke of a snubbing unit;

ii) the lower slotted cylinder and the upper slotted cylinder first configuration comprises:

(1) the top base end disposed at a position closest to the extension tip end and furthest from the bottom base end;

(2) the rib extensions aligned with the upper slots;

(3) the complementary rib extensions aligned with the lower slots; and (4) the rib extensions passing through the top base end, the upper slots and the complementary extension tip end; and iii) the lower slotted cylinder and the upper slotted cylinder second configuration comprises:

(1) the top base end disposed closest to the bottom base end and furthest from the extension tip end;

(2) the rib extensions aligned with the upper slots;

(3) the complementary rib extensions aligned with the lower slots;

(4) the rib extensions passing through the top base end, the upper slots and the complementary extension tip end; and (5) the extension tip end extending above the top base end.

15. The assembly of claim 14, wherein each traveling slip bowl comprises a segmented traveling slip bowl disposed in a friction fit engagement with the upper slotted cylinder, each complementary rib extension further comprising a through hole engagable with a respective segment of each traveling slip bowl.

16. An assembly for inserting tubular members, comprising:

a) a snubbing unit, comprising:

i) a set of stationary slip bowls disposed proximate a first base plate, ii) a set of traveling slip bowls disposed proximate a second base plate, the second base plate moveable with respect to the first base plate along a central axis defined through a center of the first base plate and the second base plate, and iii) a plurality of actuable hydraulic cylinders connecting the first base plate to the second base plate, actuation of the actuable hydraulic cylinders corresponding to movement of the second base plate relative to the first base plate;

b) a guide apparatus disposed between the first base plate and the second base plate, the guide apparatus comprising:

i) a lower slotted cylinder, comprising:

(1) a bottom base end engaged with the first base plate (2) a bottom base ring on the bottom base end; and (3) a plurality of rib extensions projecting upward from the bottom base ring to an extension tip end, the plurality of rib extensions forming lower slots between adjacent rib extensions; and ii) an upper slotted cylinder configured to selectively engage the lower slotted cylinder, the upper slotted cylinder comprising:

(1) an upper base end engaged with the second base plate;

(2) an upper base ring disposed on the upper base end; and (3) a plurality of complementary rib extensions projecting downward from the upper base ring to a complementary extension tip end, the plurality of complementary rib extensions forming upper slots between adjacent complementary rib extensions, the complementary rib extensions slidable between the rib extensions when the top base end moves between the extension tip end and the bottom base end of the lower slotted cylinder, the rib extensions extending through the upper base ring, iii) wherein:

(1) the lower slotted cylinder and the upper slotted cylinder comprise a first configuration and a second configuration, the lower slotted cylinder and the upper slotted cylinder actuating between the first configuration and the second configuration corresponding to one stroke of a snubbing unit, movement of the set of traveling slip bowls in the second base plate relative to the set of static slip bowls in the first base plate corresponding to movement of the guide apparatus between the first configuration and the second configuration;

(2) the lower slotted cylinder and the upper slotted cylinder first configuration comprises:

(a) the top base end disposed at a position closest to the extension tip end and furthest from the bottom base end;

(b) the rib extensions aligned with the upper slots;

(c) the complementary rib extensions aligned with the lower slots; and (d) the rib extensions passing through the top base end, the upper slots and the complementary extension tip end; and (3) the lower slotted cylinder and the upper slotted cylinder second configuration comprises:

(a) the top base end disposed closest to the bottom base end and furthest from the extension tip end;

(b) the rib extensions aligned with the upper slots;

(c) the complementary rib extensions aligned with the lower slots;

(d) the rib extensions passing through the top base end, the upper slots and the complementary extension tip end; and (e) the extension tip end extending above the top base end; and c) a tubular member disposed through the snubbing unit from the second base plate to the first base plate and through the guide apparatus along the central axis within the rib extensions and the complementary rib extensions.

17. The assembly of claim 16, wherein:

a) each rib extension comprises a curved inner surface; and b) each complementary rib extension comprises a complementary curved inner surface congruent with the rib extension curved inner surface, the rib extensions and the complementary rib extensions forming a generally continuous interior surface, when the rib extensions and the complementary rib extensions alternate around the central axis.

18. The assembly of claim 17, where the continuous interior surface is disposed adjacent a tubular member in the snubbing unit.

19. The assembly of claim 16, further comprising:

a) a support plate disposed between the first base plate and the second base plate adjacent to the first base plate; and b) the support plate further comprises:

i) a center hole aligned with the lower slotted cylinder; and ii) a plurality of side holes, each side hole aligned with a corresponding hydraulic cylinder of the snubbing unit, each hydraulic cylinder inserting through the support plate, the support plate being mounted in position between the first base plate and the second base plate by attachment to the hydraulic cylinders.

20. The assembly of claim 19, wherein the set of traveling slip bowls are engagable with the upper slotted cylinder, each traveling slip bowl engaging the tubular member through each complementary rib extension, the set of traveling slip bowls and the upper slotted cylinder configured to move together relative to the bottom base end of the lower slotted cylinder when the traveling slip bowls engage the tubular member.

* * * * *